US007670149B2

(12) United States Patent
Ito

(10) Patent No.: US 7,670,149 B2
(45) Date of Patent: Mar. 2, 2010

(54) ELECTRIC BOARD AND IMAGE FORMING APPARATUS

(75) Inventor: Jun Ito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/110,629

(22) Filed: Apr. 28, 2008

(65) Prior Publication Data

US 2008/0286993 A1 Nov. 20, 2008

(30) Foreign Application Priority Data

May 15, 2007 (JP) ..... 2007-129475
Mar. 10, 2008 (JP) ..... 2008-059568

(51) Int. Cl.
*H01R 12/00* (2006.01)

(52) U.S. Cl. ..... 439/79

(58) Field of Classification Search ..... 439/79, 439/76, 59–62; 361/393–395
See application file for complete search history.

(56) References Cited

U.S. PATENT DOCUMENTS 5,099,391 A * 3/1992 Maggelet et al. ..... 361/736
5,833,494 A * 11/1998 Diaz ..... 439/573
6,089,925 A * 7/2000 Maltais et al. ..... 439/701
6,205,700 B1 * 3/2001 Rigby et al. ..... 43/79
6,354,869 B1 * 3/2002 Cranston et al. ..... 439/544
6,375,508 B1 * 4/2002 Pickles et al. ..... 439/608

FOREIGN PATENT DOCUMENTS

| | | |
|---|---|---|
| JP | 5-272517 | 10/1993 |
| JP | 2002-319774 | 10/2002 |
| JP | 2002-337421 | 11/2002 |

* cited by examiner

*Primary Examiner*—Jean F Duverne
(74) *Attorney, Agent, or Firm*—Oblon, Spivak, McClelland, Maier & Neustadt, L.L.P.

(57) ABSTRACT

An electric board is configured to be removably installed in a main body of an apparatus. The electric board includes a board member on which electric components can be mounted. A shielding member is attached to the board member. A handle member is fitted on the shielding member whereby a user can hold the handle member when pulling-out the electric board from the main body.

6 Claims, 9 Drawing Sheets

ELECTRIC BOARD AND IMAGE FORMING APPARATUS

CROSS-REFERENCE TO RELATED APPLICATIONS

The present application claims priority to and incorporates by reference the entire contents of Japanese priority document 2007-129475 filed in Japan on May 15, 2007, and 2008-059568 filed in Japan on Mar. 10, 2008.

BACKGROUND OF THE INVENTION

1. Field of the Invention

The present invention relates to an electric board configured to be removably installed in a main body of an apparatus and an image forming apparatus including the electric board.

2. Description of the Related Art

In an image forming apparatus, such as a facsimile machine, a printer, a copier, and a digital multifunction product (MFP), an electric board for the image forming apparatus or an electric board for option is configured to be removably installed in a main body of the image forming apparatus. For example, in a technology disclosed in Japanese Patent Application Laid-open No. H5-272517, an electric-board installing unit is removably secured to a housing unit included in a main body of an apparatus. Furthermore, in a technology disclosed in Japanese Patent Application Laid-open No. 2002-319774, a guide rail is provided in a housing so that an electric board can be inserted into the housing by being guided on the guide rail.

FIGS. 16 and 17 are schematic diagrams for explaining how a conventional electric board is installed and removed. The electric board includes a board main body 11, a panel 12, and a connector 15. The panel 12 for covering an insertion slot is provided at one end of the board main body 11 of a main controller. The connector 15 is provided at the other end of the board main body 11, i.e., a leading end of the board main body 11 with respect to an insertion direction. The connector 15 is connected to a connector 14 on a control board 13 in a main body of the apparatus when the electric board is installed in the apparatus. Side surfaces of the board main body 11 in a direction parallel to the insertion direction are supported by a pair of guide rails 16 provided in the main body. When the electric board is to be installed in the apparatus, a user sets the side surfaces of the board main body 11 in concave portions of the guide rails 16, and pushes the panel 12.

As described above, in the conventional technologies, when the electric board is to be removed from a main body of an apparatus, a user pulls a panel directly by putting his fingers on the panel. This may cause a distortion of the panel or warpage of a board main body. Thus, the panel and a housing in which the board main body is housed may not be in contact with each other properly. Furthermore, if the panel is not in contact with the housing properly, electromagnetic waves generated from the electric board leak from a gap formed between the panel and the housing. In other words, the panel cannot sufficiently shield the electromagnetic waves due to the distortion of the panel or the warpage of the board main body.

SUMMARY OF THE INVENTION

It is an object of the present invention to at least partially solve the problems in the conventional technology.

According to an aspect of the present invention, there is provided an electric board configured to be removably installed in a main body of an apparatus. The electric board includes a board member that has a plate-like shape having a first end portion and a second end portion that are parallel to each other, and electric components are configured to be mounted thereon; a first connecting unit that is arranged on top of the first end portion, and configured to be electrically connected to a connecting unit of the apparatus; a shielding member that has a first surface and a second surface that are respectively opposite surfaces of the shielding member, the second surface being fixed to the second end portion, the first surface blocking an insertion slot of the apparatus into which the electric board is to be inserted when the first connecting unit is connected to the connecting unit; and a handle member that is fitted on the first surface whereby a user can hold the handle member when pulling-out the electric board from the main body.

According to an aspect of the present invention, there is provided an electric board configured to be removably installed in an insertion slot in a main body of an apparatus. The electric board including a board member that has a plate-like shape having a first end portion and a second end portion, wherein electric components can be mounted on board member; a plate member that has a first surface and a second surface, the second surface being fixed to the second end portion of the board member, the plate member closing the insertion slot when the electric board is installed in the insertion slot; and a handle member that is fitted on the first surface whereby a user can hold the handle member when pulling-out the electric board from the insertion slot.

According to another aspect of the present invention, there is provided an image forming apparatus comprising a main body and an electric board that can be removably installed in the main body. The electric board includes a board member that has a plate-like shape having a first end portion and a second end portion that are parallel to each other, and electric components are configured to be mounted thereon; a first connecting unit that is arranged on top of the first end portion, and configured to be electrically connected to a connecting unit of the apparatus; a shielding member that has a first surface and a second surface that are respectively opposite surfaces of the shielding member, the second surface being fixed to the second end portion, the first surface blocking an insertion slot of the apparatus into which the electric board is to be inserted when the first connecting unit is connected to the connecting unit; and a handle member that is fitted on the first surface whereby a user can hold the handle member when pulling-out the electric board from the main body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
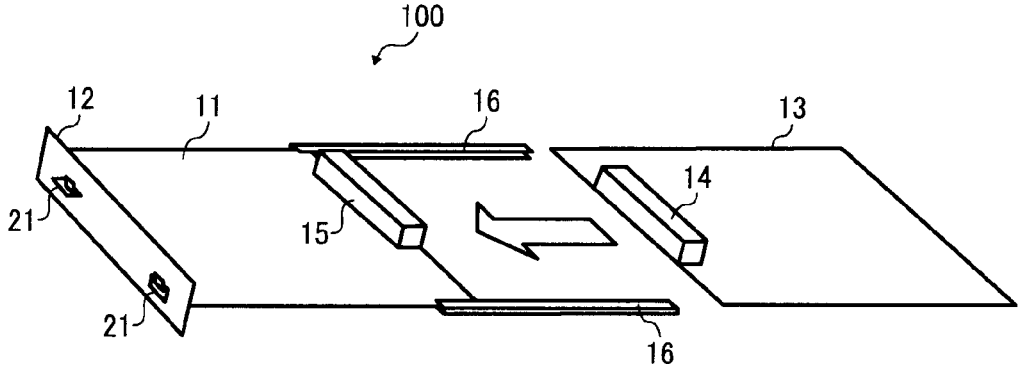
FIG. 1 is a perspective view illustrating a state where an electric board according to a first embodiment of the present invention is separated from a control board in an apparatus main body.

Exemplary embodiments of the present invention are explained in detail below with reference to the accompanying drawings. The portions identical to those in the conventional technology are denoted with the same reference numerals, and the description of those portions is omitted.

Figure 2:
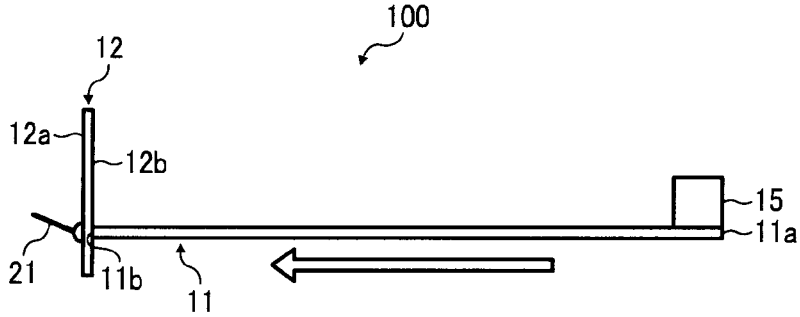
FIG. 2 is a side view of the electric board shown in FIG. 1.

FIG. 1 is a perspective view illustrating a state where an electric board 100 according to a first embodiment of the present invention is separated from the control board 13 in a main body (not shown) of an image forming apparatus (hereinafter, "the apparatus main body"). FIG. 2 is a side view of the electric board 100.

The electric board 100 includes the board main body 11, the connector 15, the panel 12, and two handles 21.

The board main body 11 has a substantially rectangular plate-like shape. Electric components, such as a central processing unit (CPU), a memory, and a hard disk drive (HDD), are mounted on the board main body 11. The board main body 11 has end portions 11*a* and 11*b* that are parallel to each other. The connector 15 is arranged on top of the end portion 11*a*. The panel 12 is fixed to the end portion 11*b*.

When the connector 15 is coupled to the connector 14 of the apparatus, the electric board 100 can be electrically connected to the apparatus.

The panel 12 is made of a substantially-rectangular plate-like member. The panel 12 has a front surface 12*a* and a rear surface 12*b*. The rear surface 12*b* is fixed to the end portion 11*b*. When the electric board 100 is inserted into an insertion slot of the image forming apparatus, and the connector 15 is coupled to the connector 14, the insertion slot is covered by the front surface 12*a*. Therefore, the panel 12 can shield electromagnetic waves generated from the electric board 100.

The handles 21 are fitted on the front surface 12*a* to be retractable with respect to the panel 12. Each of the handles 21 is made of wire, and formed into a ring shape so that a user can easily grip the handles 21 when the user wants to remove the electric board 100 from the apparatus main body. The handles 21 are arranged to be aligned in a direction perpendicular to an insertion direction of the electric board 100 with keeping a predetermined distance between them. In addition, the handles 21 are fitted on the front surface 12*a* at positions that are at about the same level as a position of the connector 15 on the board main body 11.

In this manner, in the electric board 100, the ring-shaped two handles 21 are fitted on the front surface 12*a* of the panel 12 to be aligned in the direction perpendicular to the insertion direction of the electric board 100 and at positions that are at about the same level as the position of the connector 15 on the board main body 11. When the electric board 100 is to be removed from the apparatus main body, the handles 21 are turned up to a horizontal position as the left-side handle 21 shown in FIG. 1 so that the user can easily put his fingers on the handles 21.

On the other hand, in the state that the electric board 100 is installed in the apparatus, the handles 21 are retracted to a vertical position as the right-side handle 21 shown in FIG. 1 not to cause an obstruction.

Figure 3:
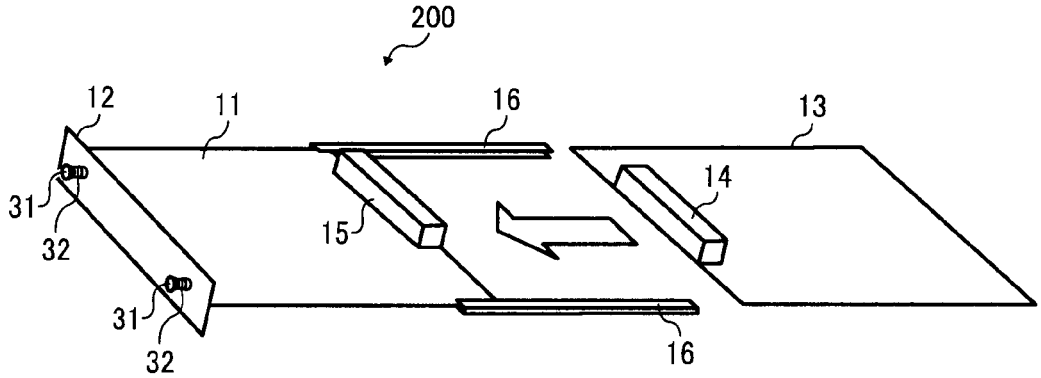
FIG. 3 is a perspective view illustrating a state where an electric board according to a second embodiment of the present invention is separated from the control board.
Figure 4:
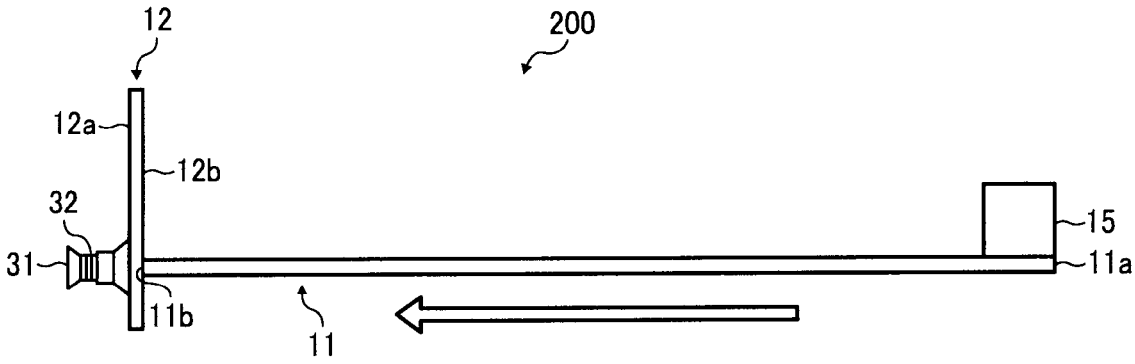
FIG. 4 is a side view of the electric board shown in FIG. 3.

FIG. 3 is a perspective view illustrating a state where an electric board 200 according to a second embodiment of the present invention is separated from the control board 13. FIG. 4 is a side view of the electric board 200.

The electric board 200 includes the board main body 11, the connector 15, the panel 12, and two handles 31. The portions identical to those in FIGS. 1 and 2 are denoted with the same reference numerals, and the description of those portions is omitted.

Each of the handles 31 has a rod-like shape. The handles 31 are fitted on the front surface 12*a* to project from the front surface 12*a*. A slit 32 for slip resistance is formed on an outer peripheral surface of each of the handles 31. The handles 31 are fitted on the front surface 12*a* at positions that are at about the same level as the position of the connector 15 on the board main body 11.

In this manner, in the electric board 200, the rod-shaped two handles 31 are fitted on the front surface 12*a* at positions that are at about the same level as the position of the connector 15 on the board main body 11, and the slit 32 is formed on the outer peripheral surface of each of the handles 31. Therefore, a user can easily grip the handles 31, so that the user can easily remove the electric board 200 from the apparatus main body.

Figure 5:
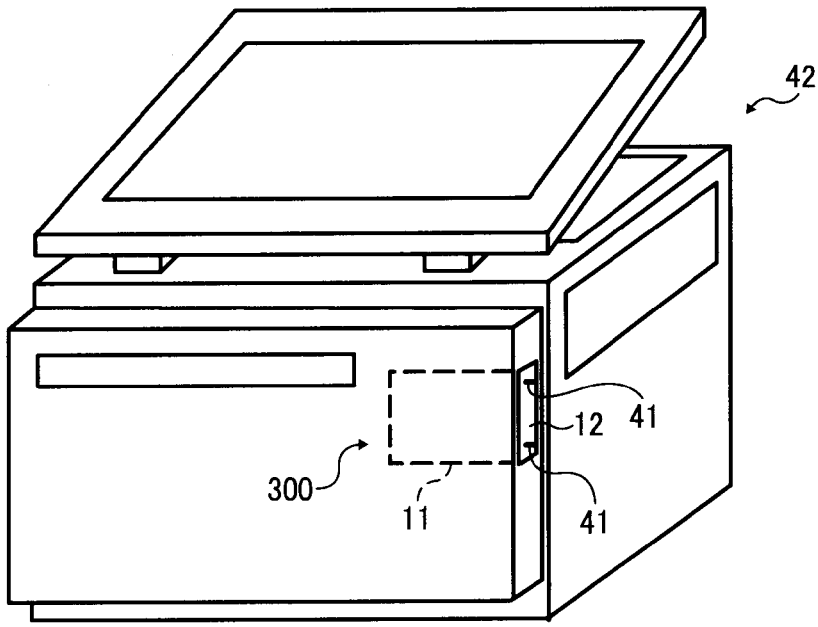
FIG. 5 is a perspective view of an image forming apparatus in which an electric board according to a third embodiment of the present invention is installed.
Figure 6:
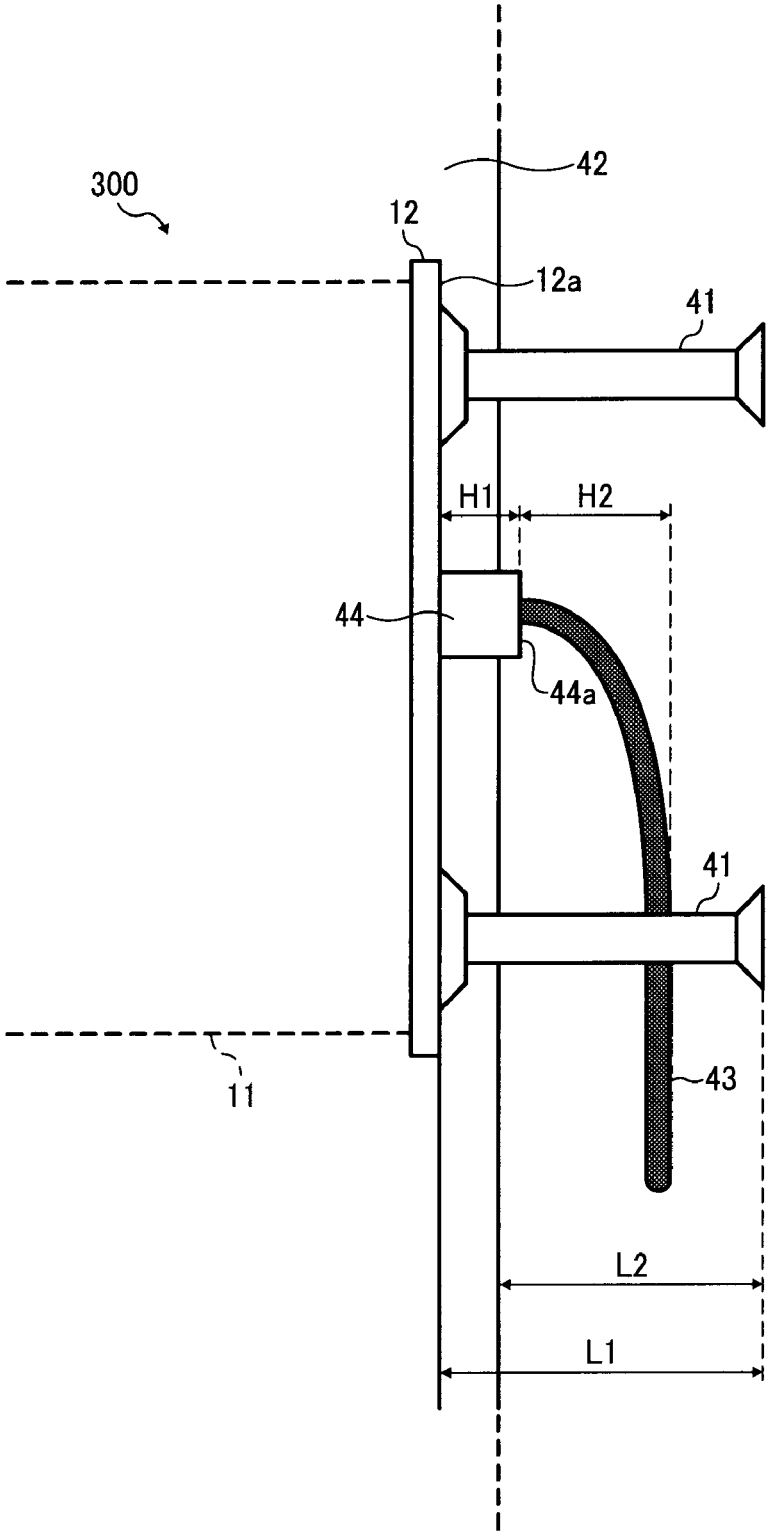
FIG. 6 is an enlarged view of the electric board shown in FIG. 5.

FIG. 5 is a perspective view of an image forming apparatus 42 in which an electric board 300 according to a third embodiment of the present invention is installed. FIG. 6 is an enlarged view of the electric board 300.

The electric board 300 includes the board main body 11, the connector 15 (not shown in FIGS. 5 and 6), the panel 12, two handles 41, a connector 44, and an interface (I/F) cable 43. The connector 44 is connected to the electric board 300 via the I/F cable 43. The portions identical to those for the first embodiment are denoted with the same reference numerals, and the description of those portions is omitted. As shown in FIG. 6, when the electric board 300 is installed in the image forming apparatus 42, the panel 12 is located on the inner side of a side surface of the image forming apparatus 42, i.e., the electric board 300 is housed inside a main body of the image forming apparatus 42.

The I/F cable 43 serves as a transmission line for connecting the main body of the image forming apparatus 42 to an external device (not shown). An electrical signal is transmitted between the main body of the image forming apparatus 42 and the external device via the I/F cable 43.

The connector 44 is provided on the front surface 12*a* of the panel 12. An end terminal of the I/F cable 43 is plugged in the connector 44, and thereby allowing the main body of the image forming apparatus 42 to be electrically connected to the external device.

Each of the handles 41 has a rod-like shape. A size of the handle 41 is configured to be larger than that of the handle 31 employed in the second embodiment.

In the third embodiment, the electric board 300 is installed in the main body of the image forming apparatus 42 in a vertical state. Therefore, when the end terminal of the I/F cable 43 is plugged in the connector 44, although the I/F cable 43 substantially horizontally projects from the connector 44, the I/F cable 43 gradually extends downward in a vertical direction by gravity. As a result, the I/F cable 43 has a curved portion between a substantially-horizontal portion and a substantially-vertical portion thereof.

In this state, a length of the handle 41, i.e., a distance from the front surface 12*a* to an end of the handle 41 on the opposite side of the panel 12 is referred to as a length L1. A distance from a position where the connector 44 is arranged on the front surface 12*a* to a plug-in surface 44*a* of the connector 44 where the end terminal of the I/F cable 43 is plugged is referred to as a length H1. The maximal length from the plug-in surface 44*a* to the curved portion of the I/F cable 43 is referred to as a length H2. A distance from the side surface of the image forming apparatus 42 on the side where the electric board 300 is to be installed/removed to the end of the handle 41 on the opposite side of the panel 12 is referred to as a length L2.

The length L1 is longer than the total sum of the length H1 and the length H2 (L1>H1+H2). The length L2 is longer than a diameter of the I/F cable 43.

The length of the handle 41, i.e., the length L1 is defined as described above, so that the handles 41 can sufficiently protrude from the main body of the image forming apparatus 42. The handles 41 having such a length are fitted on the front surface 12*a*, so that enough space can be kept between the main body of the image forming apparatus 42 and a wall or the like. Therefore, it is possible to protect cables including the I/F cable 43 from being squeezed between the main body and the wall. Incidentally, a slit for slip resistance can be formed on an outer peripheral surface of each of the handles 41 in the same manner as the slit 32 formed on each of the handles 31 in the second embodiment.

Figure 7:
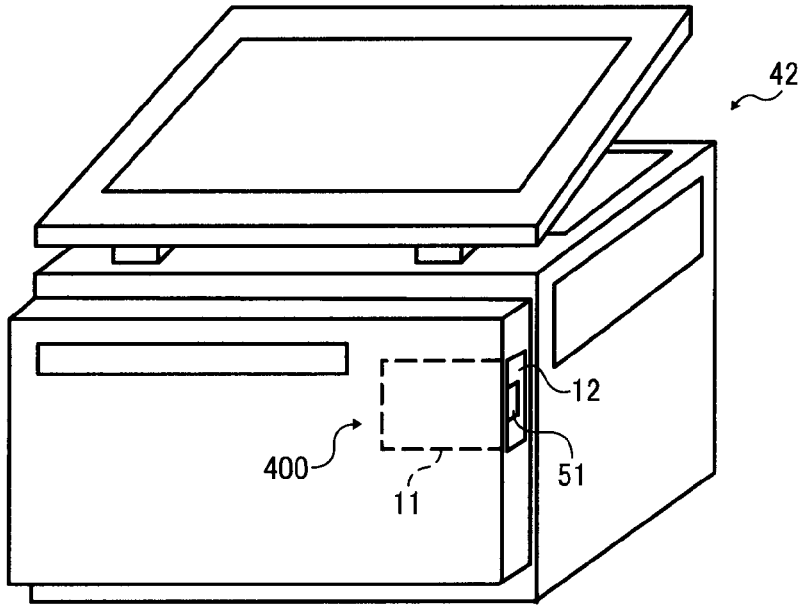
FIG. 7 is a perspective view of the image forming apparatus in which an electric board according to a fourth embodiment of the present invention is installed.
Figure 8:
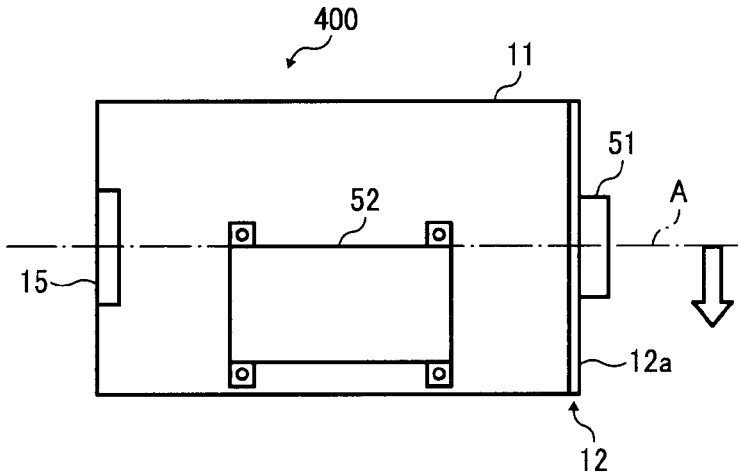
FIG. 8 is an enlarged view of the electric board shown in FIG. 7.

FIG. 7 is a perspective view of the image forming apparatus 42 in which an electric board 400 according to a fourth embodiment of the present invention is installed. FIG. 8 is an enlarged view of the electric board 400.

The electric board 400 includes the board main body 11, the connector 15, the panel 12, a handle 51, and an HDD 52. The portions identical to those for the first and third embodiments are denoted with the same reference numerals, and the description of those portions is omitted. The electric board 400 is installed in the main body of the image forming apparatus 42 in the vertical state, i.e., a surface of the electric board 400 on which electric components are mounted is also in the vertical state.

The handle 51 is made of a metal plate, and has a fold where a user can put his fingers on the handle 51. The handle 51 is fitted on the front surface 12*a* of the panel 12 to project from the front surface 12*a*. Furthermore, the handle 51 is fitted on the front surface 12*a* at a position that is at about the same level as the position of the connector 15 on the board main body 11. In the same manner as in the third embodiment, it is preferable that a length of the handle 51 projecting from the panel 12 is longer than the total sum of the length H1 and the length H2. In this case, it is possible to protect cables from being squeezed between the apparatus main body and the wall.

The HDD 52 has a relatively heavy weight, so that the HDD 52 is mounted on the board main body 11 below a center line A of the board main body 11 in a vertical direction as shown in FIG. 8. In this manner, when an electric component of a relatively heavy weight such as the HDD 52 is mounted on the board main body 11, the electric component is arranged on the lower side to keep a balance. As a result, the electric board 400 can be easily installed in or removed from the main body of the image forming apparatus 42.

Incidentally, if the HDD 52 cannot be arranged below the center line A due to a size of the HDD 52 relative to that of the board main body 11, the HDD 52 could be arranged in such a manner that the center of gravity of the HDD 52 is located below the center line A. In the fourth embodiment, the HDD 52 is explained as an example of an electric component of a relatively heavy weight. However, such an electric component is not limited to the HDD 52. For example, a floppy (registered trade name) disk drive of a relatively heavy weight is also to be arranged in the same manner as the HDD 52.

Figure 9:
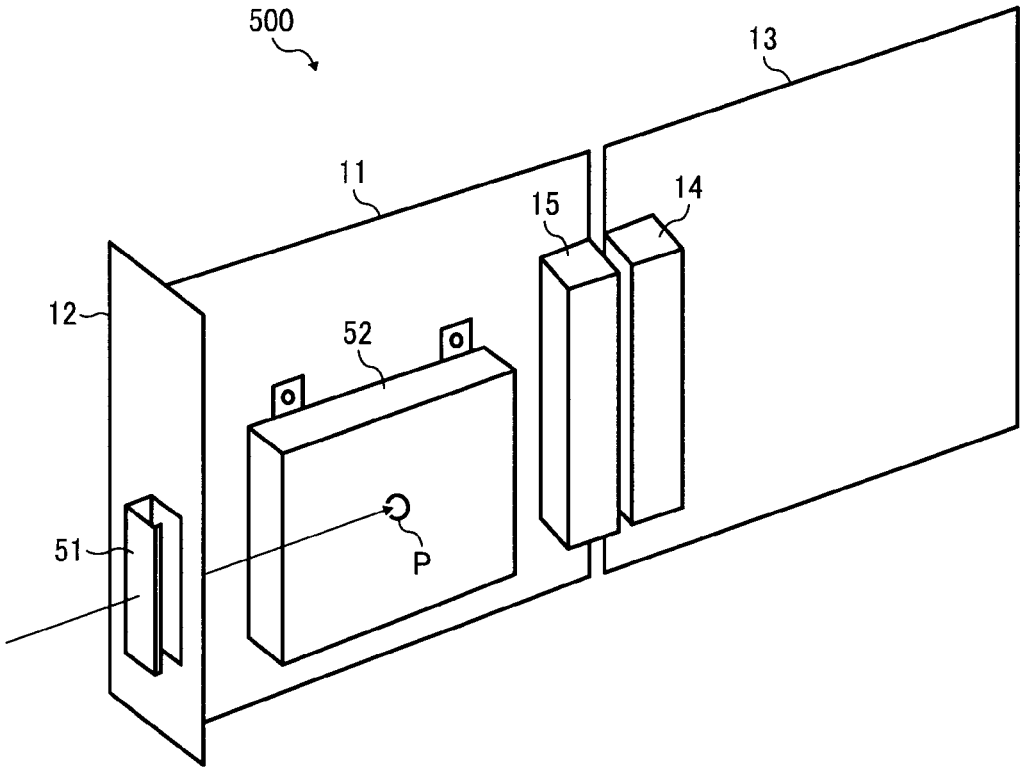
FIG. 9 is a perspective view illustrating a state where an electric board according to a fifth embodiment of the present invention is coupled to the control board.
Figure 10:
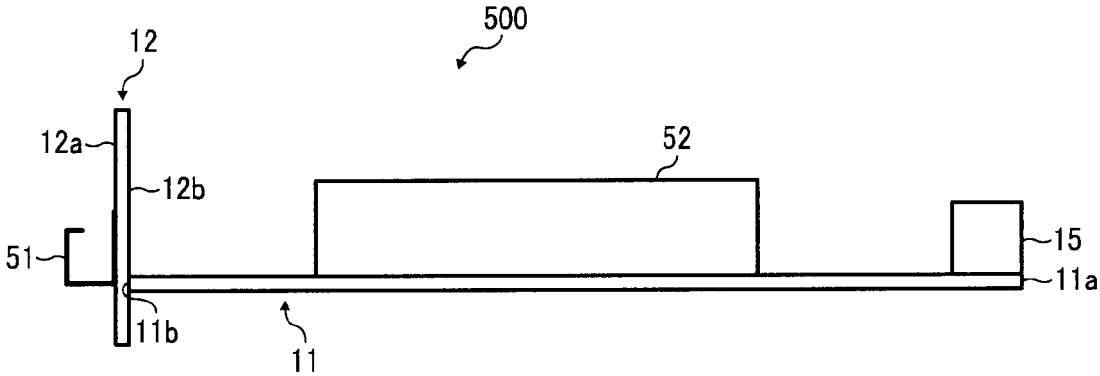
FIG. 10 is a side view of the electric board shown in FIG. 9.

FIG. 9 is a perspective view illustrating a state where an electric board 500 according to a fifth embodiment of the present invention is coupled to the control board 13 in the apparatus main body. FIG. 10 is a side view of the electric board 500.

The electric board 500 includes the board main body 11, the connector 15, the panel 12, the handle 51, and the HDD 52. The portions identical to those for the first and fourth embodiments are denoted with the same reference numerals, and the description of those portions is omitted. The electric board 500 can be installed in the image forming apparatus 42 instead of the electric board 400. The electric board 500 is installed in the vertical state, i.e., a surface of the electric board 500 on which electric components are mounted is also in the vertical state.

In the fifth embodiment, the handle 51 is fitted on the front surface 12*a* at a position that is at about the same level as a gravity point P that is the center of gravity of the board main body 11. More particularly, as shown in FIG. 9, the handle 51 is located below a center line of the board main body 11 in a vertical direction. In other words, the handle 51 is fitted on the front surface 12*a* of the panel 12 in such a manner that a distance from a bottom surface to a center line of the panel 12 in a vertical direction is substantially equal to a distance from the bottom surface of the panel 12 to the level of the gravity point P in the vertical direction.

In this manner, the handle 51 is fitted on the front surface 12*a* at a position that is at about the same level as the gravity point P of the board main body 11. Therefore, the board main body 11 can be balanced after the electric board 500 is pulled out from the image forming apparatus 42. In other words, a user can easily remove the electric board 500 from the main body of the image forming apparatus 42.

Figure 11:
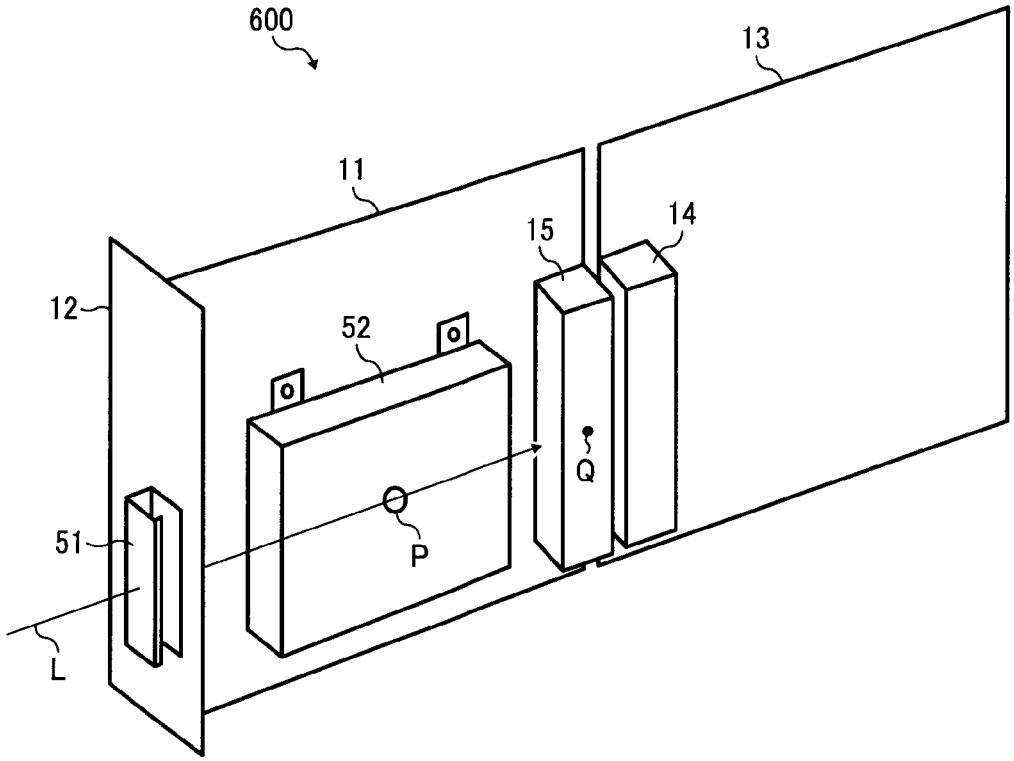
FIG. 11 is a perspective view illustrating a state where an electric board according to a sixth embodiment of the present invention is coupled to the control board.
Figure 12:
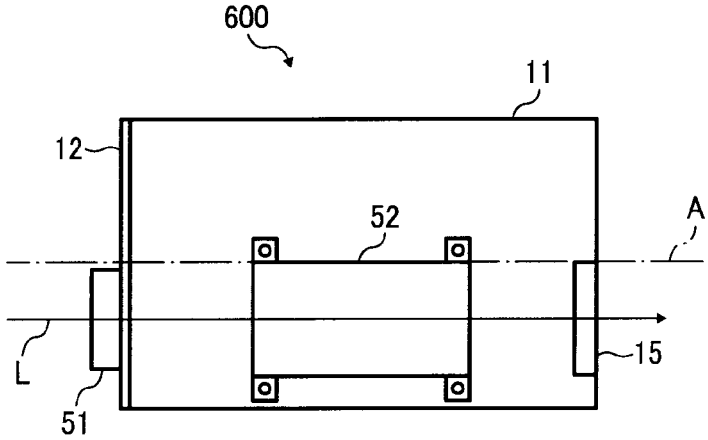
FIG. 12 is a side view of the electric board shown in FIG. 11.

FIG. 11 is a perspective view for explaining a state where an electric board 600 according to a sixth embodiment of the present invention is coupled to the control board 13. FIG. 12 is a side view of the electric board 600.

The electric board 600 includes the board main body 11, the connector 15, the panel 12, the handle 51, and the HDD 52. The portions identical to those for the first and fourth embodiments are denoted with the same reference numerals, and the description of those portions is omitted. The electric board 600 can be installed in the image forming apparatus 42 instead of the electric board 400. The electric board 600 is installed in the vertical state, i.e., a surface of the electric board 600 on which electric components are mounted is also in the vertical state.

In the sixth embodiment, the handle 51 and the connector 15 are arranged in such a manner that the gravity point P of the board main body 11 falls on or near a straight line L passing through a center point of the handle 51 and a center point Q of the connector 15. If the center point of the handle 51 is located on the same level as a bottom surface or a top surface of the connector 15, a pulling force is applied only to either the bottom surface or the top surface of the connector 15. As a result, the connector 15 may be distorted upward or downward, and thus the connector 15 may fail to be coupled to the connector 14 properly. However, in the sixth embodiment, the handle 51 and the connector 15 are arranged as described above, so that the pulling force is uniformly applied to the connector 15. Therefore, the connector 15 can be reliably coupled to or separated from the connector 14. In addition, a user can easily remove the electric board 600 from the main body of the image forming apparatus 42.

Figure 13:
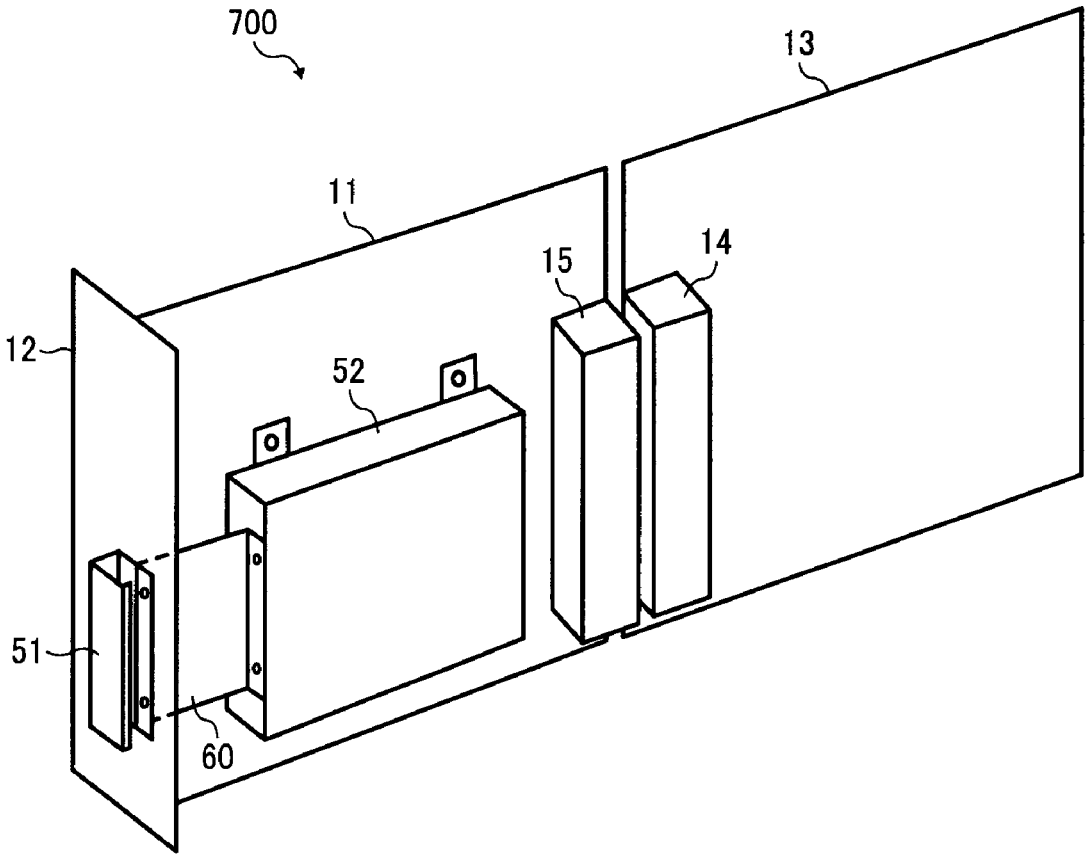
FIG. 13 is a perspective view illustrating a state where an electric board according to a seventh embodiment of the present invention is coupled to the control board.

FIG. 13 is a perspective view for explaining a state where an electric board 700 according to a seventh embodiment of the present invention is coupled to the control board 13. The electric board 700 can be installed in the image forming apparatus 42 instead of the electric board 400. The electric board 700 is installed in the vertical state, i.e., a surface of the electric board 700 on which electric components are mounted is also in the vertical state.

The electric board 700 includes the board main body 11, the connector 15, the panel 12, the handle 51, the HDD 52, and a supporting plate 60. The portions identical to those for the first and sixth embodiments are denoted with the same reference numerals, and the description of those portions is omitted.

One end of the supporting plate 60 is fixed to the handle 51 and the other end is fixed to the HDD 52. In other words, the handle 51 is integrated with the HDD 52 of a relatively heavy weight via the supporting plate 60. Therefore, a structural strength of the electric board 700 can be improved. Consequently, it is possible to prevent a distortion or a deformation of the electric board 700 that may be caused when the electric board 700 is removed from the main body of the image forming apparatus 42.

Incidentally, a size of the handle 51 can be increased so that the handle 51 can also serve as a cover of a slot (not shown) for an expanded memory card.

Figure 14:
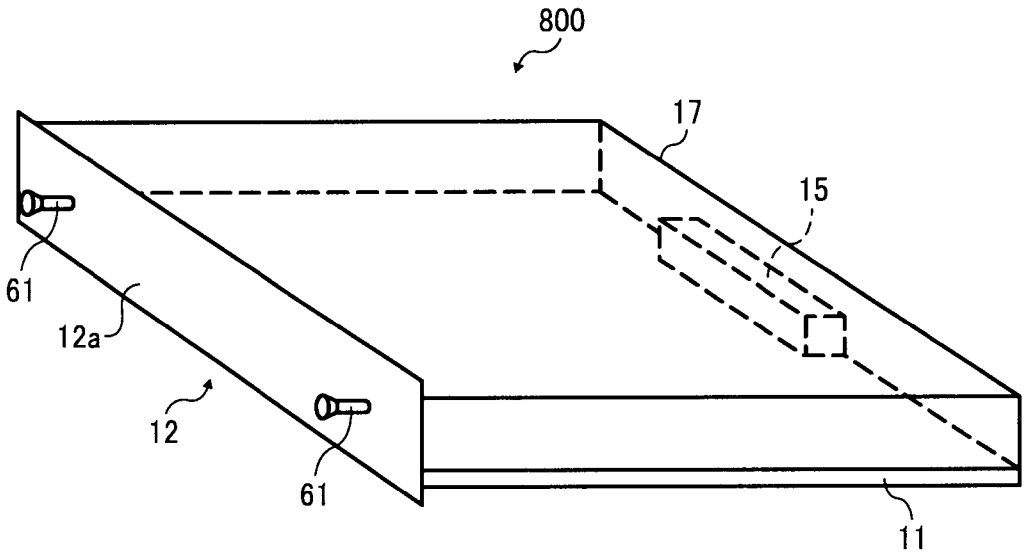
FIG. 14 is a perspective view of an electric board according to an eighth embodiment of the present invention.

FIG. 14 is a perspective view of an electric board 800 according to an eighth embodiment of the present invention. The electric board 800 includes the board main body 11, the connector 15, the panel 12, two handles 61, and a cover member 17. The portions identical to those for the first embodiment are denoted with the same reference numerals, and the description of those portions is omitted.

The cover member 17 is attached to the board main body 11 and the panel 12 so as to form a rectangular parallelepiped together with the board main body 11 and the panel 12. Namely, a bottom surface and one of side surfaces of the rectangular parallelepiped are composed of the top surface of the board main body 11 and the panel 12, respectively. The other side surfaces of the rectangular parallelepiped are composed of the cover member 17. The connector 15 is housed inside the rectangular parallelepiped.

Each of the handles 61 has a rod-like shape. The handles 61 are fitted on the panel 12 to project from the on the front surface 12*a*. The handles 61 are arranged in such a manner that a distance from the bottom surface of the panel 12 to each of the handles 61 in the vertical direction is substantially equal to a distance from the level of the bottom surface of the panel 12 to the center of gravity of the rectangular parallelepiped in the vertical direction in a state where the electric board 800 is installed in the main body of the apparatus. In other words, in the eighth embodiment, the handles 61 are fitted on the front surface 12*a* at positions that are at about the same level as the center of gravity of the rectangular parallelepiped.

In this manner, the cover member 17 is provided to the electric board 800, so that it is possible to shield electromagnetic waves generated from the electric board 800. In the electric board 800, the handles 61 are arranged at positions that are at about the same level as the center of gravity of the rectangular parallelepiped in consideration for a weight of the cover member 17. Therefore, the board main body 11 can be balanced, so that a user can easily remove the electric board 800 from the main body of the apparatus.

Incidentally, the fitting positions of the handles 61 on the panel 12 can be made adjustable. If a cover member having a different weight from that of the cover member 17 is provided to the electric board 800 instead of the cover member 17, or if the number of electric components mounted on the board main body 11 increases or decreases, the position of the handles 61 can be adjusted depending on the center of gravity of the rectangular parallelepiped.

Figure 15:
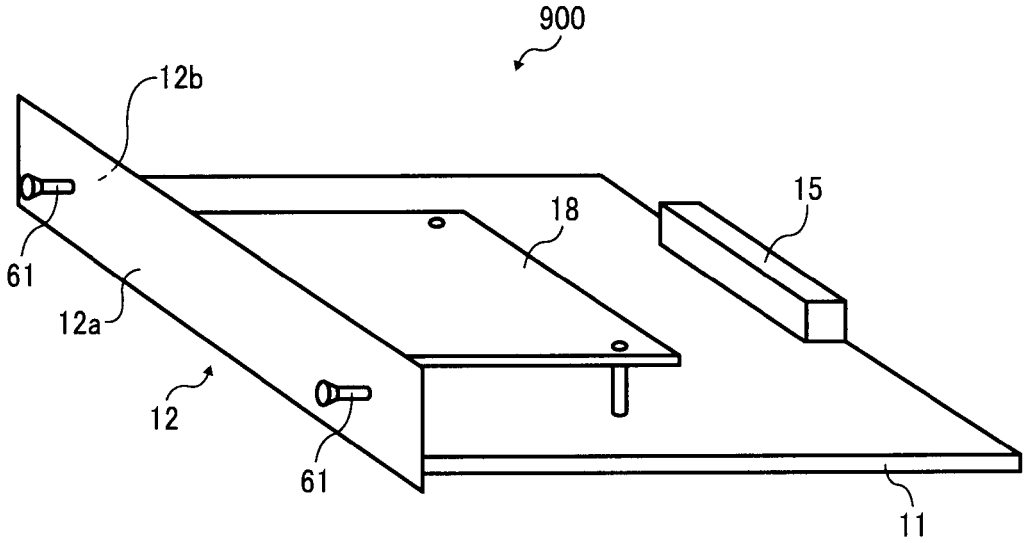
FIG. 15 is a perspective view of an electric board according to a ninth embodiment of the present invention.
Figure 16:
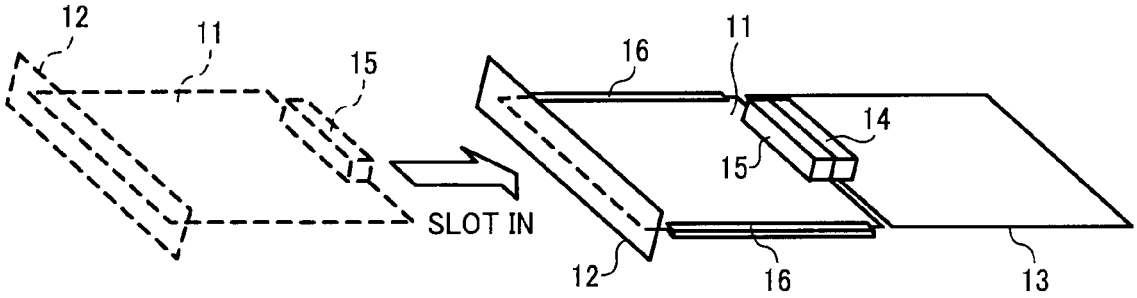
FIG. 16 is a perspective view for explaining how an electric board according to a conventional technology is coupled to the control board.
Figure 17:
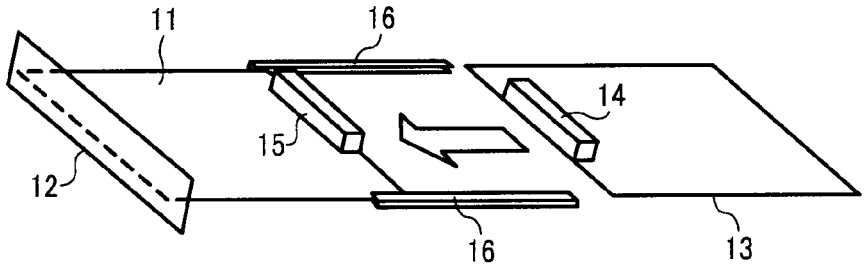
FIG. 17 is a perspective view of for explaining how the electric board shown in FIG. 16 is separated from the control board.

FIG. 15 is a perspective view of an electric board 900 according to a ninth embodiment of the present invention. The electric board 900 includes the board main body 11, the connector 15, the panel 12, the handles 61, and an extension board 18. The portions identical to those for the first and eighth embodiments are denoted with the same reference numerals, and the description of those portions is omitted.

The extension board 18 has a plate-like shape, and electric components (not shown) are mounted thereon. The extension board 18 is arranged above the board main body 11 in such a manner that one side surface of the extension board 18 is attached to the rear surface 12*b* of the panel 12.

Each of the handles 61 has a rod-like shape. The handles 61 are fitted on the panel 12 to project from the front surface 12*a*. The handles 61 are arranged in such a manner that a distance from the bottom surface of the panel 12 to each of the handles 61 in the vertical direction is substantially equal to a distance from the level of the bottom surface of the panel 12 to the center of gravity of the board main body 11 and the extension board 18 in the vertical direction in a state where the electric board 900 is installed in the main body of the apparatus. In other words, in the ninth embodiment, the handles 61 are fitted on the front surface 12*a* at positions that are at about the same level as the center of gravity of the board main body 11 and the extension board 18.

In this manner, the extension board 18 is provided to the electric board 900 in addition to the board main body 11, so that the handles 61 are arranged at positions that are at about the same level as the center of gravity of the board main body 11 and the extension board 18 in consideration for a weight of the extension board 18. Therefore, the board main body 11 can be balanced, so that a user can easily remove the electric board 900 from the main body of the apparatus.

Incidentally, the fitting positions of the handles 61 on the panel 12 can be made adjustable. If an extension board having a different weight from that of the extension board 18 is provided to the electric board 900 instead of the extension board 18, or if the number of electric components mounted on the board main body 11 or the extension board 18 increases or decreases, the position of the handles 61 can be adjusted depending on the center of gravity of the board main body 11 and the extension board 18.

The present invention is not limited to the above embodiments. Each of components used in the embodiments can change in its shape without departing from the scope of the invention. Furthermore, various inventions can be made by combinations of the components. For example, any of the components can be eliminated, or another component can be arbitrarily combined with any of the components.

According to an aspect of the present invention, a handle is fitted on a shielding member fixed to an end portion of a board main body so that a user can easily grip the handle and pull-out an electric board from a main body of an apparatus. Furthermore, contact between the shielding member and the main body of the apparatus can be improved. Therefore, it is possible to shield electromagnetic waves generated from the electric board.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric board configured to be removably installed in a main body of an apparatus, the electric board comprising:

a board member that has a plate-like shape having a first end portion and a second end portion that are parallel to each other, and electric components are configured to be mounted thereon;

a first connecting unit that is arranged on top of the first end portion, and configured to be electrically connected to a connecting unit of the apparatus;

a shielding member that has a first surface and a second surface that are respectively opposite surfaces of the shielding member, the second surface being fixed to the second end portion, the first surface blocking an insertion slot of the apparatus into which the electric board is to be inserted when the first connecting unit is connected to the connecting unit;

a cable used for transmission and reception of an electrical signal between the apparatus and an external device;

a second connecting unit that is arranged on the first surface, and one end terminal of the cable is plugged therein so that the apparatus is electrically connected to the external device; and a handle member that is fitted on the first surface whereby a user can hold the handle member when pulling-out the electric board from the main body, the handle member having a rod-like shape and projecting from the shielding member, wherein a length of the handle member is longer than a total sum of a length from a contact surface of the second connecting unit where the second connecting unit has contact with the first surface to a plug-in surface of the second connecting unit where the end terminal of the cable is plugged and a maximal length from the plug-in surface to a curved portion of the cable in a direction perpendicular to the plug-in surface.

2. An image forming apparatus on which the electric board according to claim 1 is detachably mounted.

3. An electric board configured to be removably installed in a main body of an apparatus, the electric board comprising:

a board member that has a plate-like shape having a first end portion and a second end portion that are parallel to each other, and electric components are configured to be mounted thereon;

a first connecting unit that is arranged on top of the first end portion, and configured to be electrically connected to a connecting unit of the apparatus;

a shielding member that has a first surface and a second surface that are respectively opposite surfaces of the shielding member, the second surface being fixed to the second end portion, the first surface blocking an insertion slot of the apparatus into which the electric board is to be inserted when the first connecting unit is connected to the connecting unit; and a handle member that is fitted on the first surface whereby a user can hold the handle member when pulling-out the electric board from the main body, wherein the handle member projects from the first surface, and is made of a plate-like member having a fold so that the user can put his fingers on the fold, the electric board is installed in the main body in such a manner that a surface of the electric board on which the electric components are to be mounted is in a vertical state, and the electric board further comprises a component of a relatively heavy weight that is mounted on the board member in such a manner that a center of gravity of the component is located below a center line of the board member in a vertical direction in a state where the electric board is installed in the main body.

4. An electric board configured to be removably installed in a main body of an apparatus, the electric board comprising:

a board member that has a plate-like shape having a first end portion and a second end portion that are parallel to each other, and electric components are configured to be mounted thereon;

a first connecting unit that is arranged on top of the first end portion, and configured to be electrically connected to a connecting unit of the apparatus;

a shielding member that has a first surface and a second surface that are respectively opposite surfaces of the shielding member, the second surface being fixed to the second end portion, the first surface blocking an insertion slot of the apparatus into which the electric board is to be inserted when the first connecting unit is connected to the connecting unit; and a handle member that is fitted on the first surface whereby a user can hold the handle member when pulling-out the electric board from the main body, wherein the handle member is fitted on the first surface in such a manner that a distance from a bottom surface to a center line of the shielding member in a vertical direction is substantially equal to a distance from a level of the bottom surface to a center of gravity of the board member in the vertical direction in a state where the electric board is installed in the main body, the handle member projects from the first surface, and is made of a plate-like member having a fold so that the user can put his fingers on the fold, the electric board is installed in the main body in such a manner that a surface of the electric board on which the electric components are to be mounted is in a vertical state, and the electric board further comprises a component of a relatively heavy weight that is mounted on the board member in such a manner that a center of gravity of the component is located below a centerline of the board member in a vertical direction in a state where the electric board is installed in the main body.

5. The electric board according to claim 4, wherein the handle member and the first connecting unit are arranged in such a manner that a center of gravity of the electric board is located on or near a straight line passing through a center point of the handle member and a center point of the first connecting unit.

6. The electric board according to claim 4, wherein the electric board is installed in the main body in such a manner that a surface of the electric board on which the electric components are to be mounted is in a vertical state, and the electric board further comprises a supporting member which both ends are respectively fixed to the handle member and the component of the relatively heavy weight mounted on the board member so that the handle member is integrated with the component of the relatively heavy weight via the supporting member.

* * * * *